US006196719B1

(12) United States Patent
Brown

(10) Patent No.: US 6,196,719 B1
(45) Date of Patent: Mar. 6, 2001

(54) TIP-OVER DISCHARGEABLE BULK BAG

(75) Inventor: Bobby Glenn Brown, Dennison, TX (US)

(73) Assignee: B.A.G. Corp., Dallas, TX (US)

( * ) Notice: Subject to any disclaimer, the term of this patent is extended or adjusted under 35 U.S.C. 154(b) by 0 days.

(21) Appl. No.: 09/613,915

(22) Filed: Jul. 11, 2000

(51) Int. Cl.[7] ..... B65D 33/02
(52) U.S. Cl. ..... 383/109; 383/104; 383/119
(58) Field of Search ..... 383/104, 109, 383/119

(56) References Cited

U.S. PATENT DOCUMENTS

| | | | | |
|---|---|---|---|---|
| 3,896,991 | * | 7/1975 | Kozlowski et al. | 383/119 |
| 4,903,859 | * | 2/1990 | Derby et al. | 383/104 |
| 5,158,369 | * | 10/1992 | Derby | 383/119 |
| 5,209,364 | * | 5/1993 | LaPoint, Jr. | 383/109 |
| 5,289,937 | * | 3/1994 | Boots | 383/119 |
| 5,323,922 | * | 6/1994 | Lapoint, Jr. et al. | 383/119 |
| 5,423,611 | * | 6/1995 | Sherrard | 383/119 |
| 5,556,205 | * | 9/1996 | Gallie et al. | 383/109 |
| 5,897,211 | | 4/1999 | Hafer et al. | 383/119 |
| 6,000,549 | | 12/1999 | Perkins | 206/596 |
| 6,004,035 | | 12/1999 | Hafer et al. | 383/119 |
| 6,015,057 | | 1/2000 | Stone et al. | 220/9.2 |

FOREIGN PATENT DOCUMENTS

| | | |
|---|---|---|
| PCT/IE96/00078 | 12/1996 | (WO) . |
| PCT/IE/99/00115 | 11/1999 | (WO) . |

* cited by examiner

*Primary Examiner*—Stephen P. Garbe
(74) *Attorney, Agent, or Firm*—Michael A. O'Neil

(57) ABSTRACT

A tip-over dischargeable bulk bag comprises a bottom wall and four double layer side walls extending upwardly from the bottom wall and secured end to end to form four corners which define the rectangular enclosure. Stiffeners are received between the double layers of the side walls and are secured either by sewn seams or by releaseable fasteners. Baffles extend across the corners of the bulk bag and receive stiffeners which are secured by sewn seams or by releaseable fasteners. The baffles may be provided with apertures to facilitate the complete filling of the bulk bag.

6 Claims, 4 Drawing Sheets

TIP-OVER DISCHARGEABLE BULK BAG

TECHNICAL FIELD

The present invention relates generally to receiving, transporting, storing and discharging dry flowable solids, and more particularly to a bulk bag which is turned upside down to effect discharge therefrom.

BACKGROUND AND SUMMARY OF THE INVENTION

Traditionally, bags having capacities of between about 50 pounds and about 100 pounds have been used to receive, transport, store, and discharge dry flowable solids such as minerals and chemicals, foodstuffs, etc. More recently, flexible intermediate bulk containers, commonly referred to as bulk bags, have come into widespread use for receiving, transporting, storing, and discharging dry flowable solids and other materials. Although numerous bulk bag designs are known, most bulk bags are adapted to receive materials through the top and to discharge the previously received materials through the bottom of the bulk bag.

In certain industries large boxes are utilized in the handling of dry flowable solids. In use, the boxes are received in machinery which functions to tip the boxes upside down to effect rapid discharge of the contents therefrom. Although generally satisfactory, the use of boxes in the handling of dry flowable solids involves certain disadvantages. For example, boxes are generally not adapted to be folded for transport. Additionally, the cleaning and recycling of boxes utilized in the handling of dry flowable solids can be problematic.

U.S. Pat. No. 4,903,859 discloses a bulk bag comprising four double layer side walls. Stiffeners formed from cardboard are inserted between the layers of the side walls thereby imparting sufficient rigidity to the container to permit its use with liquids. Although the bulk bag of the '859 patent has been generally well received, its utilization has been somewhat limited by the fact that it cannot be stacked.

Co-pending application Ser. No. 09/390,403 assigned to the assignee hereof (doing business as Composite Container Corp.) discloses an improvement over the bulk bag of the '859 patent. In application Ser. No. 09/390,403 there is disclosed a bulk bag having double layer side walls and vertically extending corner pockets. Plywood sheets are received between the layers of the side walls and wooden posts are received in the corner pockets to provide a bulk bag suitable for use with liquids which is stackable.

U.S. Pat. No. 5,076,710 discloses a baffle-type bulk bag wherein bridge panels or baffles are sewn across the four corners of a nominally rectangular bulk bag. The baffles prevent the side walls of the bulk bags from bulging outwardly when the bulk bag is filled, thereby retaining the filled bulk bag in a more or less rectangular cross-sectional configuration. The baffles may be provided with apertures which allow material to flow into and out of the corners of the bulk bag during filling and discharging operations.

The present invention comprises a bulk bag which adapts the technologies of the '859 and '710 patents and the '403 application to provide a bulk bag which functions as a replacement for the material handling boxes described hereinabove. The bulk bags of the present invention incorporate numerous advantages over the prior art material handling boxes. A primary advantage involves the fact that the bulk bags of the present invention are adapted to be folded flat for transport from the location at which the bags are manufactured to the location at which the bags are used, and for return transport from the location at which the bags are emptied to the location at which the bags are filled. Another advantage arising from the use of the invention involves the fact that the bulk bags of the present invention are adapted for cleaning and recycling.

BRIEF DESCRIPTION OF THE DRAWINGS

A more complete understanding of the invention may be had by reference to the following Detailed Description, when taken in conjunction with the accompanying Drawings, wherein.

DETAILED DESCRIPTION

Figure 1:
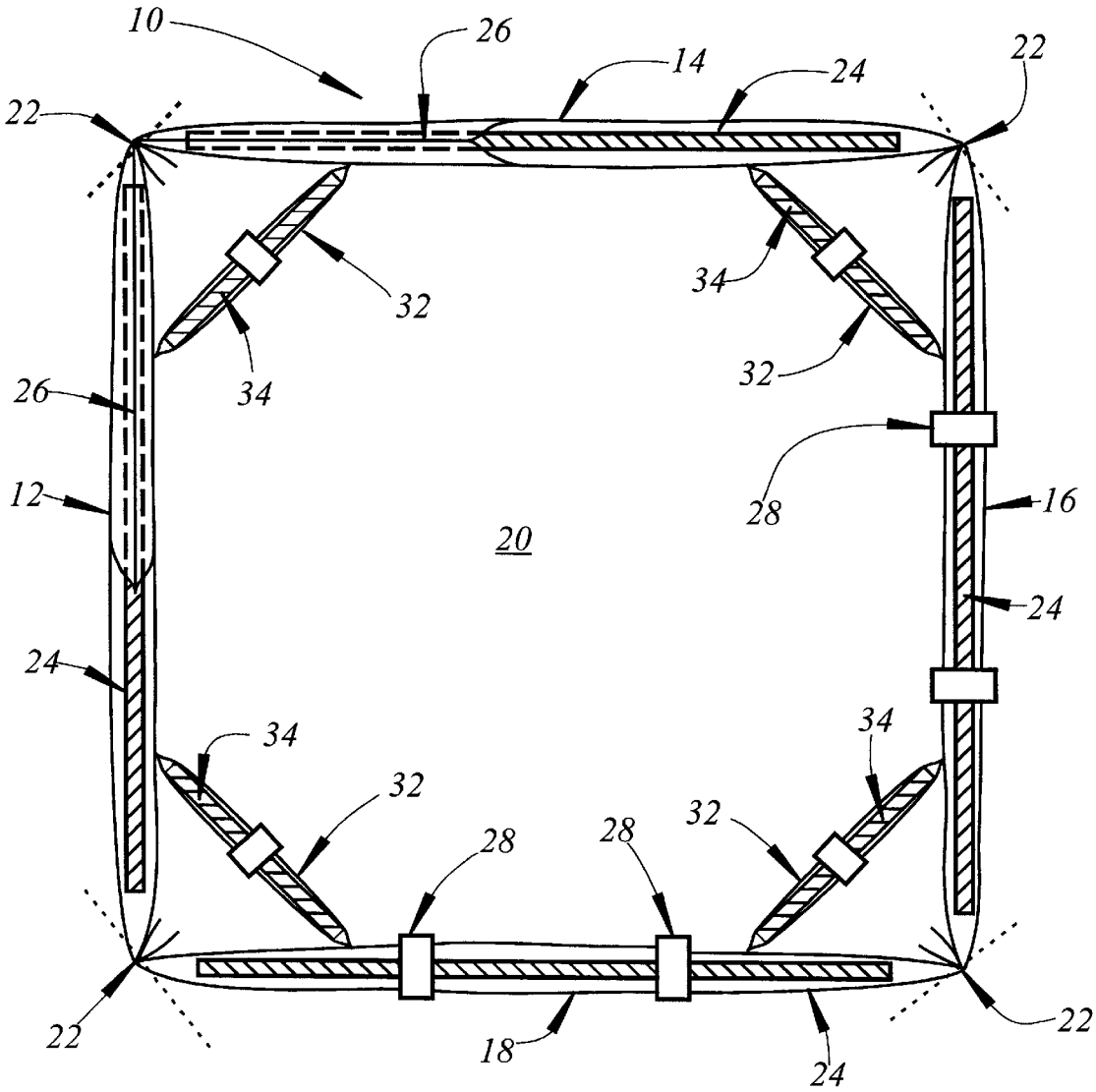
FIG. 1 is a top view illustrating a bulk bag comprising a first embodiment of the invention.

Referring now to the Drawings, and particularly to FIG. 1 thereof, there is shown a bulk bag 10 comprising a first embodiment of the invention. The bulk bag 10 comprises four double layer side walls 12, 14, 16, and 18 and a bottom wall 20. The side walls 12, 14, 16, and 18 and the bottom wall 20 are preferably formed from woven polypropylene fabric, however, other materials may be used in the practice of the invention depending upon the requirements of particular applications thereof.

The side walls 12, 14, 16, and 18 are joined to the bottom wall 20 by sewing. The side walls 12, 14, 16, and 18 are joined end to end also by sewing, thereby defining four corners 22. In this manner there is defined a square or rectangular enclosure.

The side walls 12, 14, 16, and 18 each comprise a double layer side wall having a stiffener panel 24 received therein. The stiffener panels 24 may be manufactured from plastic panels of the type sold by Coroplast of Dallas, Tex. under the trademark "COREX" (TM). Other types of plastic panels may also be used, depending upon the requirements of particular applications of the invention. The stiffener panels 24 may also be formed from medium density fiberboard, as well as other materials.

The stiffener panels 24 of the side walls 12 and 14 are preferably permanently secured in place. For example, the stiffener panels 24 of the side walls 12 and 14 may be secured in place by a sewn or adhesively secured top seam 26. Conversely, the stiffener panels 24 of the side walls 16 and 18 are preferably releaseably secured in place by fasteners 28. The fasteners 28 may comprise hook and loop type fasteners of the type sold under the trademark "VELCRO"®, or any of various other types and kinds of conventional fasteners.

The bulk bag 10 further includes four baffles 32 each extending across one of the corners 22 and secured to the adjacent side walls by sewing. Each of the baffles 32 has a stiffener panel 34 releaseably secured therein. The stiffener panels 34 are secured in place by fasteners 38. The fasteners 38 preferably comprise hook and loop type fasteners of the type sold under the trademark "VELCRO"® although other types and kinds of conventional fasteners may also be utilized in the practice of the invention.

When the stiffener panels 24 and 34 are installed and secured in place in the bulk bag 10 in the manner illustrated in FIG. 1, the bulk bag 10 has sufficient rigidity to facilitate tip-over discharge therefrom. That is, the bulk bag 10 may be received in the same type of machinery that has heretofore been utilized in conjunction with boxes and which functions to tip the bulk bag 10 upside down to rapidly discharge the contents therefrom. When the fasteners 28 and 38 are released and the stiffening panels 24 and 34, which are normally secured thereby are removed, the bulk bag 10 is foldable into a fully flat configuration to facilitate transport of the bulk bag from its point of manufacture to its point of use, and return transport from its point of discharge to its point of refilling.

Figure 2:
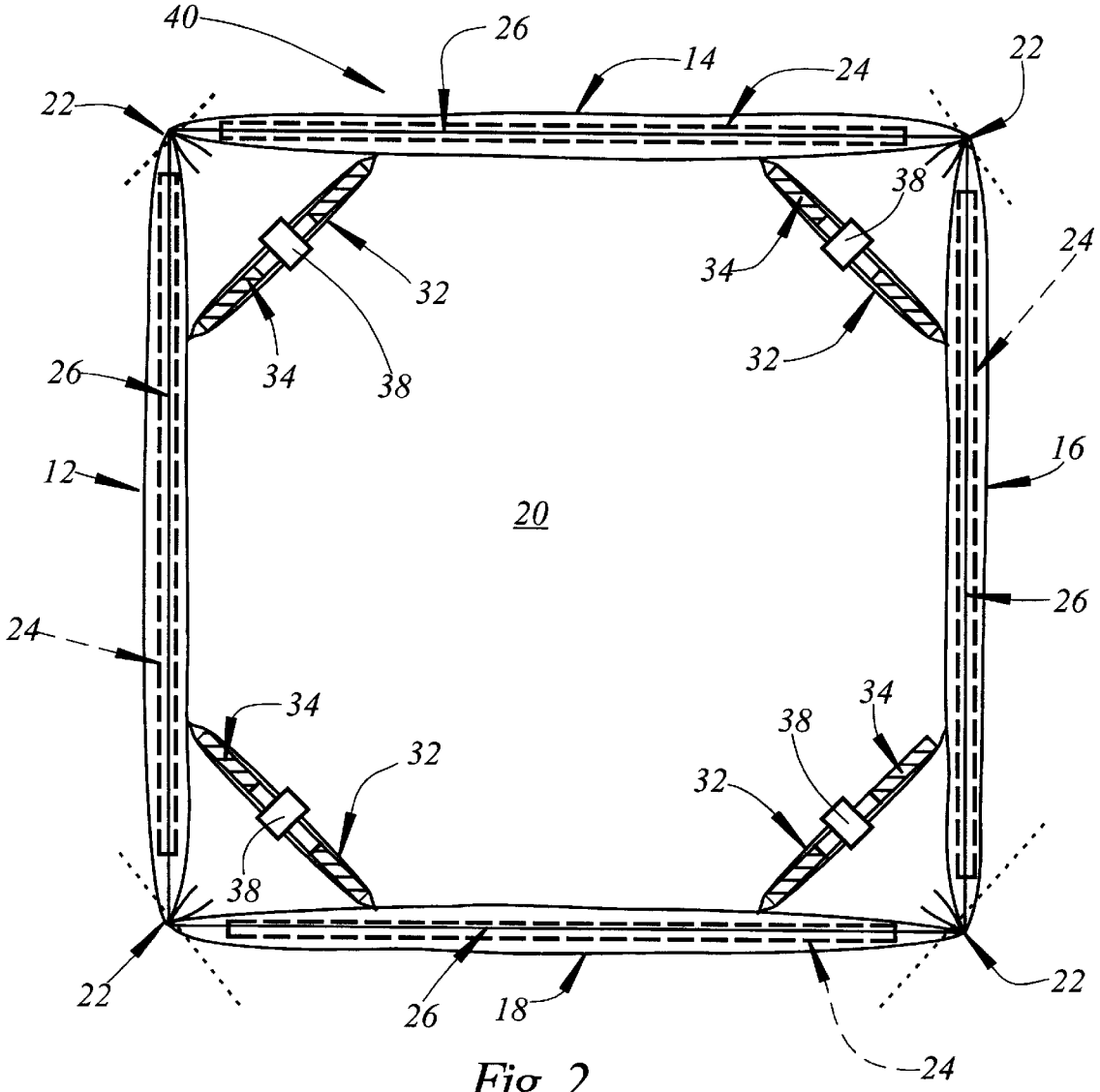
FIG. 2 is a top view illustrating a bulk bag comprising a second embodiment of the invention.

Referring to FIG. 2, there is shown a bulk bag 40 comprising a second embodiment of the invention. The bulk bag 40 is substantially identical in construction and function to the bulk bag 10 described hereinabove. The bulk bag 40 differs from the bulk bag 10 in that all four of the side walls 12, 14, 16, and 18 have stiffener panels 24 permanently secured therein by a sewn top seam 26. The bulk bag 40 may nevertheless be folded substantially flat for transport by releasing the fasteners 38 and removing the stiffener panels 34 from the baffles 32.

Figure 3:
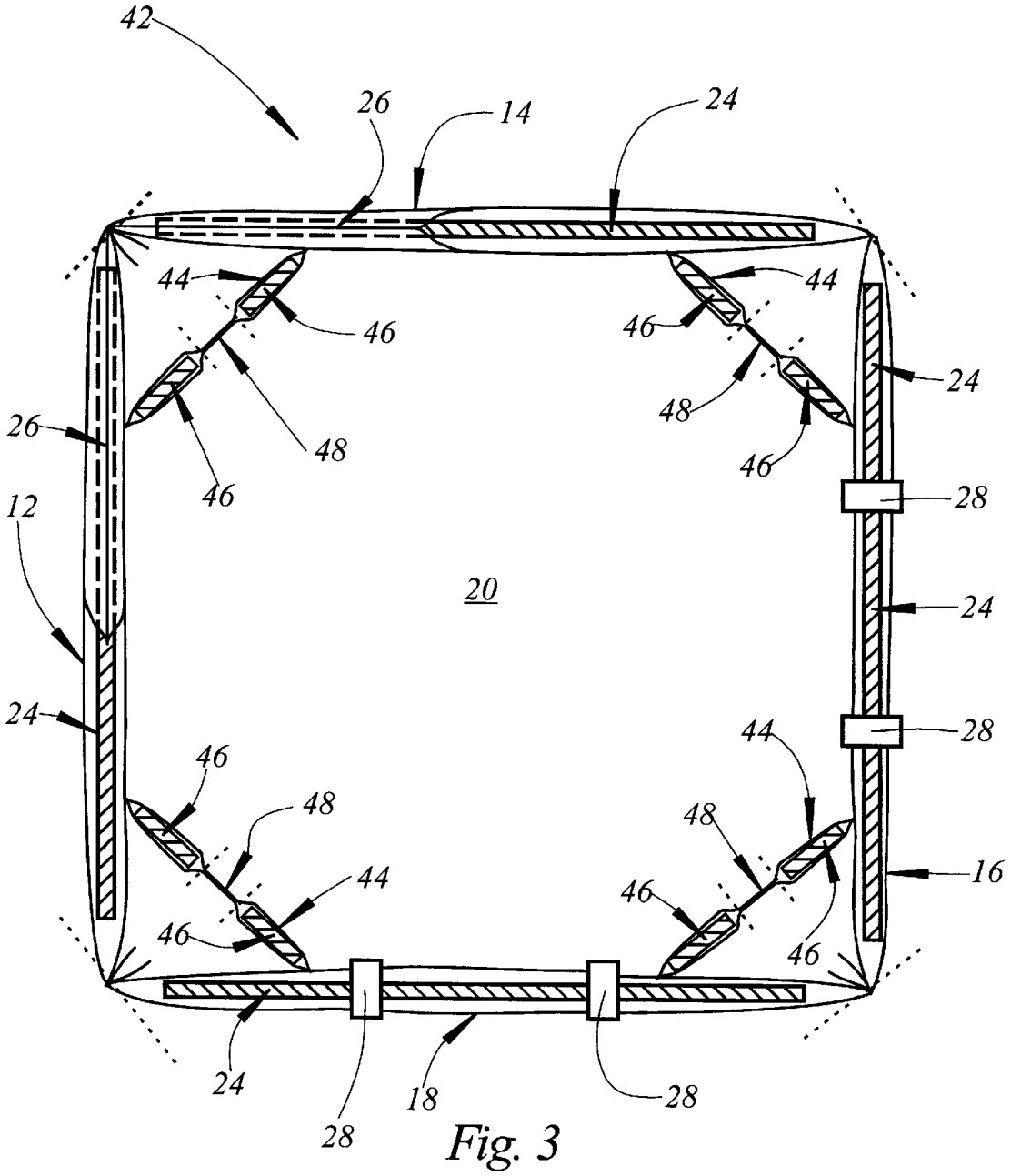
FIG. 3 is a top view illustrating a bulk bag comprising a third embodiment of the invention.
Figure 4:
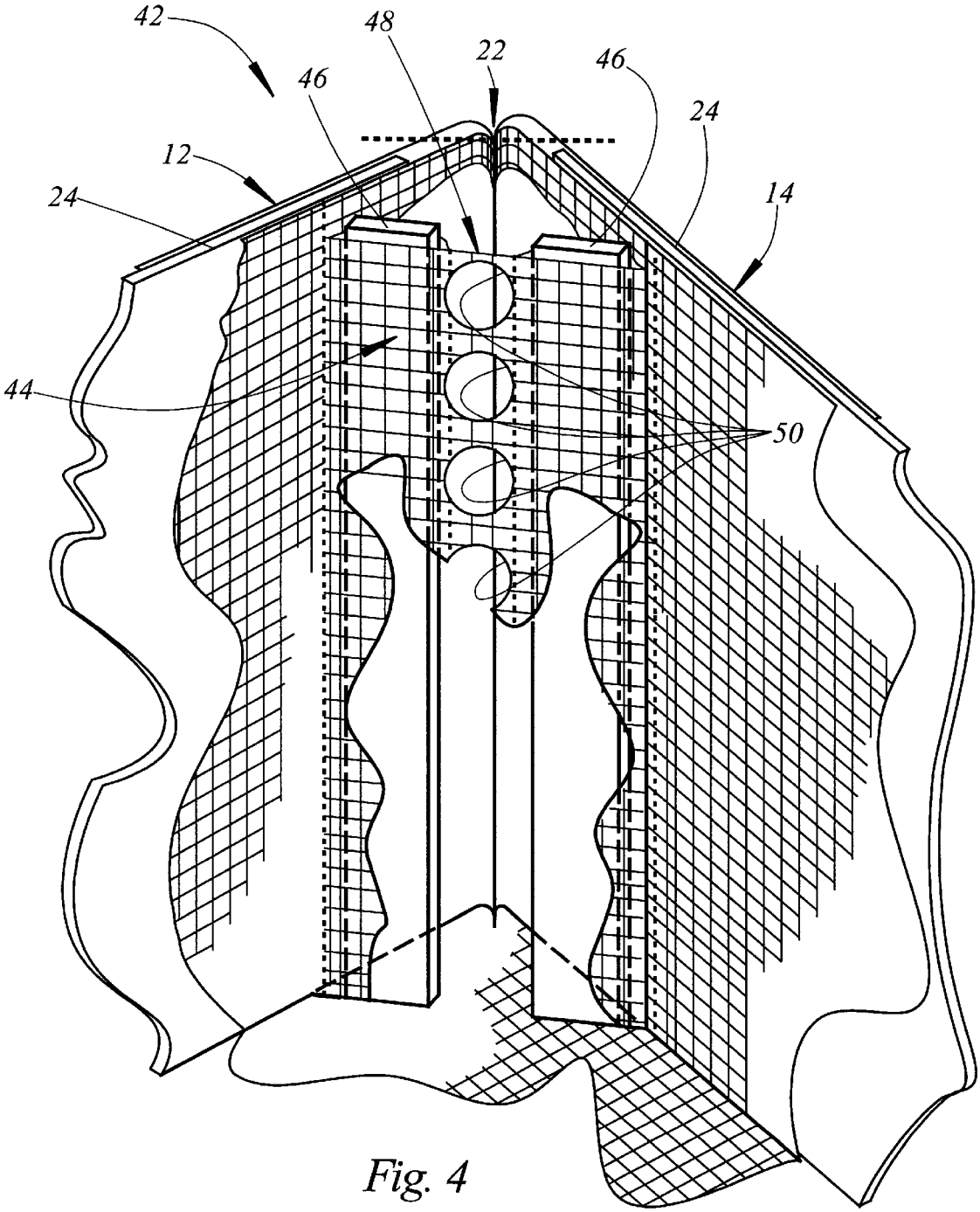
FIG. 4 is a partial perspective view of the bulk bag of FIG. 3.

Referring to FIGS. 3 and 4, there is shown a bulk bag 42 comprising a third embodiment of the invention. The bulk bag 42 is substantially identical in construction and function to the bulk bag 10 illustrated in FIG. 1 and described hereinabove in conjunction therewith. The bulk bag 42 differs from the bulk bag 10 in that the bulk bag 42 comprises baffles 44 each of which receives two stiffener panels 46 which are sewn in place at the opposite ends thereof. Each stiffener panel 46 further includes a flexible center portion 48 having a plurality of apertures 50 formed therein. The flexible nature of the center portion 48 facilitates folding of the bulk bag 42 for transport without requiring the removal of the stiffener panels 46. The use of the apertures 50 in the baffles 44 allows the bulk bag 42 to be completely filled with dry flowable materials.

Although preferred embodiments of the invention have been illustrated in the accompanying drawings and described in the foregoing Detailed Description, it will be understood that the invention is not limited to the embodiments disclosed, but is capable of numerous rearrangements, modifications, and substitutions of parts and elements without departing from the spirit of the invention.

What is claimed is:

1. A tip-over dischargeable bulk bag comprising:

a bottom wall;

four double layer side walls connected to and extended upwardly from the bottom wall and connected end to end at four corners to define the rectangular enclosure;

four stiffener panels each received between the double layers of one of the side walls;

four double layer baffles each extending across one of the corners and connected to the adjacent side walls; and four stiffener panels each received between the double layer comprising one of the baffles; and means for retaining the stiffener panels within the side walls and within the baffles to facilitate turning the bulk bag upside down to facilitate rapid discharge therefrom.

2. The tip-over dischargeable bulk bag according to claim 1 wherein the double layer side walls are secured to the bottom wall by sewn seams, wherein the double layer side walls are secured end to end by sewn seams, and wherein the stiffener retaining means includes at least one sewn seam for securing at least one of the stiffeners between the double layer comprising one of the side walls.

3. The tip-over dischargeable bulk bag according to claim 1 wherein the stiffener securing means comprises four sewn seams each for securing one of the stiffeners between the double layers of one of the side walls and for releaseable fasteners each for securing one of the stiffeners between the double layers of one of the baffles.

4. The tip-over dischargeable bulk bag according to claim 1 wherein the stiffener securing means comprises two sewn seams each for securing one of the stiffeners between the double layers comprising one of the side walls;

two releaseable fasteners each for securing one of the stiffeners between the double layers of one of the side walls; and four releaseable fasteners each for securing one of the stiffeners between the double layers of the baffles.

5. The tip-over dischargeable bulk bag according to claim 1 further characterized by:

two stiffener portions each received between the double layer of each of the baffles and positioned in a spaced apart relationship;

sewn seams for securing the stiffener portions between the double layers of the baffles; and a plurality of apertures extending between both of the double layers at each of the baffles and situated in a vertical array to facilitate the filling of the corners of the bulk bag.

6. The tip-over dischargeable bulk bag comprising:

a bottom wall;

four double layer side walls secured to and extending upwardly from the bottom wall and joined end to end to form four corners which define a rectangular enclosure;

four stiffeners each received between the double layers of one of the side walls;

means for retaining the stiffeners between the double layers of the side walls and thereby facilitate turning the bulk bag upside down to effect discharge of the contents thereof;

four double layer baffles each extending across one of the corners of the bulk bag and secured to the adjacent side walls thereof;

eight stiffener panels, two of the stiffener panels being received between the double layers of each of the baffles and positioned in a spaced apart relationship;

means for retaining the stiffener panels between the double layers of the baffles; and a plurality of apertures extending through both of the double layers of each of the baffles to facilitate the filling of the corners of the bulk bag.

* * * * *